United States Patent [19]

Porter

[11] 4,258,409

[45] Mar. 24, 1981

[54] ELECTROGASDYNAMIC COATING APPARATUS

[75] Inventor: Donald H. Porter, Ocean County, N.J.

[73] Assignee: Estey Dynamics Corporation, Red Bank, N.J.

[21] Appl. No.: 18,794

[22] Filed: Mar. 8, 1979

[51] Int. Cl.[3] ..... B05B 5/00

[52] U.S. Cl. ..... 361/227; 239/706

[58] Field of Search ..... 361/225, 226, 227, 228, 361/229; 239/706

[56] References Cited

U.S. PATENT DOCUMENTS

| | | | |
|---|---|---|---|
| 3,667,674 | 6/1972 | Parsons et al. | 361/227 X |
| 4,020,393 | 4/1977 | Porter | 361/227 |
| 4,039,145 | 8/1977 | Felici et al. | 239/706 |

*Primary Examiner*—Harry E. Moose, Jr.

*Attorney, Agent, or Firm*—Anthony J. Casella; Michael A. Stallman

[57] ABSTRACT

An apparatus and method for applying powdered coating materials includes a central channel for directing the powdered coating material passed a conduit that mixes an air jet with the powdered material. The powder is then ionized and forced outwardly towards the workpiece. A conductive cathode attractor ring for creating a corona space charge which ionizes the particles is provided and includes a radially inner porous portion. Contamination of the attractor ring due to adherence thereon of powder particles is inhibited by diverting a secondary pressurized air flow through said porous portion thereby dislodging powder particles adhering to the ring. The porous inner portion is formed of a sintered mass of individual particles which provides an increased surface area for the attractor ring that, in turn, increases the corona space charge. A slidable deflector member is provided at the end of the central channel to alter the spray pattern of the apparatus.

6 Claims, 8 Drawing Figures

ELECTROGASDYNAMIC COATING APPARATUS

The subject of this invention relates to an apparatus of the type disclosed in U.S. Pat. No. 4,020,393 entitled ELECTROGASDYNAMIC COATING DEVICE HAVING COMPOSITE NON-CONDUCTIVE FLOW CHANNEL, AND HOLLOW IONIZATION ELECTRODE FOR AN AIR JET, which issued on Apr. 26, 1977, and which is assigned to the assignee of the subject application.

More particularly, the improvement of the subject invention resides in a new and improved construction of an attractor ring of an electrogasdynamic apparatus, which attractor ring has a radially inner portion that is porous. By this arrangement, the build-up of powder particles on the attractor ring may be reduced or eliminated by providing a secondary air flow through the porous portion of the attractor ring for dislodging any particles adhering thereto. Additionally, because of an increase in the effective surface area of the attractor ring obtained by virtue of the inner porous portion thereof, the corona discharge efficiency of the apparatus is increased. The subject invention also discloses a new and improved method for the electrogasdynamic coating of particles onto a workpiece, said particles may be of the dry powdered type or of the wet paint type.

In previous electrogasdynamic systems, contamination of the attractor ring due to an accumulation of particles thereon, operated to reduce the efficiency of the system. During operation of prior art systems, as particles would build-up on the attractor ring a measurable degradation of the corona effect would occur thereby resulting in decreased efficiency of the coating process. Specifically, the degradation of the corona space charge would decrease the charged powder output, increase cost of production, and increase maintenance costs. Efforts to minimize this degradation included forcing air through the anode needle and polishing the cathode attractor ring. The forcing of air through the anode needle inhibited the build-up of powder on the needle and in the vicinity of the corona discharge. In addition, the polishing of the attractor ring made adherence of the particles thereon more difficult. However, none of the solutions in the prior art would enable the gun to run for extended periods of time since the eventual build-up of particles necessitated the periodic cleaning of the attractor ring.

Accordingly, it is an object of the subject invention to overcome the shortcomings of the prior art devices and provide a new and improved electrogasdynamic apparatus and process which decreases the build-up of contaminants on the attractor ring, thus increasing the efficiency of the system.

It is another object of the subject invention to provide an electrogasdynamic system which operates over continuously long periods of time, provides a constant or uniform non-varying space charge to the particles, and provides more efficient powder coatings to the objects to be coated.

It is still a further object of the subject invention to provide an electrogasdynamic system with an attractor ring which has a greater effective surface area for increasing the corona discharge efficiency.

It is another object to provide a new and improved electrogasdynamic system which is cheaper to operate and requires less maintenance and down time.

In accordance with these and other objects and advantages of the invention, the subject electrogasdynamic apparatus includes an elongated non-conductive conduit having a conductive needle and a conductive attractor ring adjacent to the needle for creating a corona discharge therebetween when a source of potential is connected to the conductive members. Pressurized air and coating particles are forced through the non-conductive conduit and then through the corona discharge for ionizing the coating particles preparatory to the particles being propelled toward a grounded workpiece for effecting electrogasdynamic coating of the latter. The attractor ring is preferably formed of two conductive portions, the radially inner portion of which is porous and may be made of sintered, electrically conductive metallic particles. A secondary source of pressurized air is provided to the attractor ring and flows through the radially inner porous portion thereof at an angle to the main flow of forced pressurized air, and is effective in dislodging any coating particles which adhere to the attractor ring. Accordingly, the surface of the attractor ring is maintained uncontaminated, thereby increasing the efficiency the electrogasdynamic gun or apparatus. In the process of the subject invention, during operation of the electrogasdynamic gun, a secondary air flow is forced through the attractor ring at an angle to the main flow of pressurized air for dislodging contaminant particles which may adhere to the radially inner surface of said attractor ring.

Further objects and advantages of the present invention will become apparent from the following detailed description, taken in conjunction with the drawings, in which.

Figure 1:
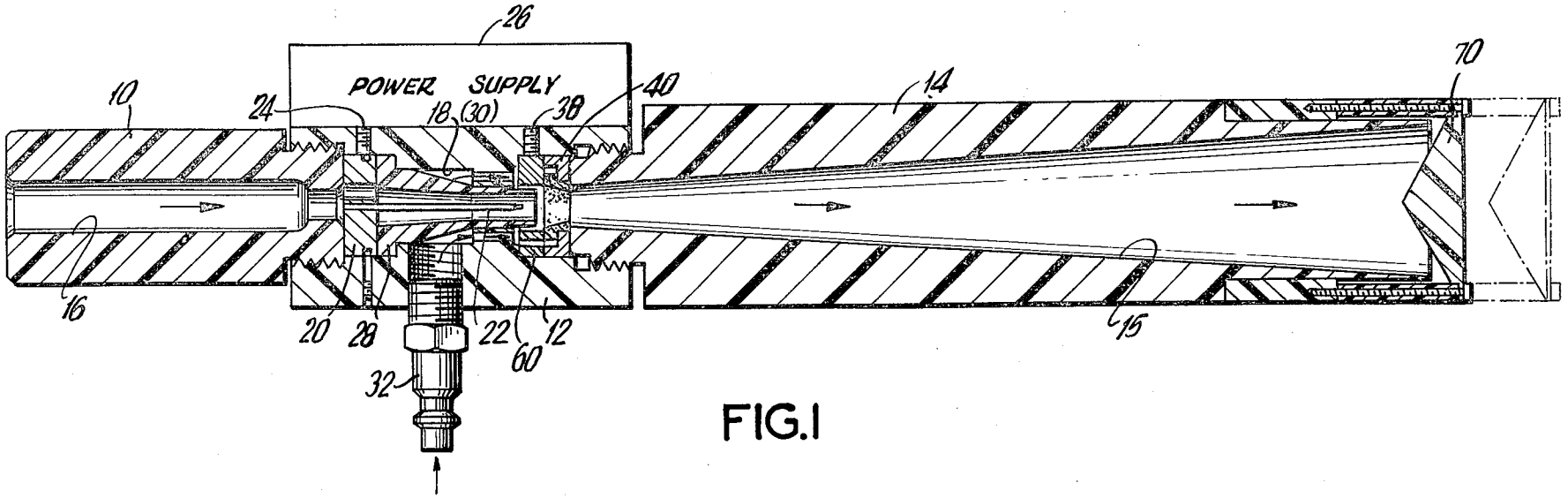
FIG. 1 is a cross-sectional view of the electrogasdynamic coating device of the subject invention.

Referring now to FIG. 1, the electrogasdynamic coating device of the subject invention includes three major sections, preferably made of DELRIN, a trademark of an acetal resin derived by polmerization of formaldehyde and made by DuPont Corporation of Wilmington, Del. The three sections are the entrance pipe 10, which is threadably received within an insulator block 12, and a flow tube 14 threadably received in the opposed end of the insulator block 12. Flow tube 14 includes a funnel shaped flow channel 15 for directing the coating particles. Entrance pipe 10 is connected to a powder reservoir (not shown), and has a central channel 16 running longitudinally therethrough which communicates with a like channel 18 through the insulator block 12. Fitted in channel 18 is a conductive washer 20 which supports a centrally disposed electrically conductive hollow needle 22. Washer 20 is securely held in place by the end of entrance pipe 10. The washer 20 contains three holes (not shown) in a clover leaf configuration for the passage of coating powder. Washer 20 is preferably made of brass and is connected to a conductive terminal 24 which is, in turn, connected to the power supply 26 that provides the ionizing potential for the anode needle 22.

Disposed adjacent to the conductive washer 20 is a generally funnel shaped, dilution tube 28 which directs the main flow of particles. The narrowed wall of the dilution tube 28 communicating with central channel 18 forms an annular space 30. Air under pressure is brought into the system through side tube 32, with the major portion of the air passing through the annular space 30, surrounding dilution tube 28. The pressurized air which then flow towards flow channel 15 draws the powder from entrance tube 10, by aspirator action, into the central opening of the dilution tube 28, then through flow channel 15, and towards the workpiece to be coated.

A minor or secondary portion of the pressurized air from side tube 32 is diverted to a second flow path (not shown), and through the hollow needle, emerging at the center of dilution tube 28. By this arrangement a build-up of powder on the needle 22 is inhibited.

The insulator block is provided with a plurality of openings 34 (see FIG. 6) which communicate with annular space 30 to channel the air flow towards the flow channel 15. As illustrated in the enlarged view of FIG. 5, the plurality of openings 34 communicate with annular space 30. In the embodiment of the invention as shown in FIGS. 1–7, an annular chamber 36 is provided to permit diversion of part of the pressurized air flow. The main portion of the pressurized air flow is directed through the annular chamber 36 where it increases in velocity and passes into the flow channel 15. As seen in FIG. 1, an attractor ring 40 is connected to terminal 38 to create the corona discharge for ionizing the coating particles which are drawn through the dilution tube 28. As the powder particles reach the end of the dilution tube 28, the electrical discharge between the needle 22 and the attractor ring 40 ionizes the particles, and they are then mixed with the pressurized air stream and drawn through flow channel 15 to the workpiece to be coated.

Figure 4:
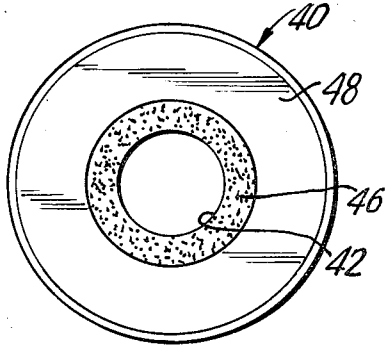
FIG. 4 is an elevational view of the downstream side of the attractor ring.
Figure 2:
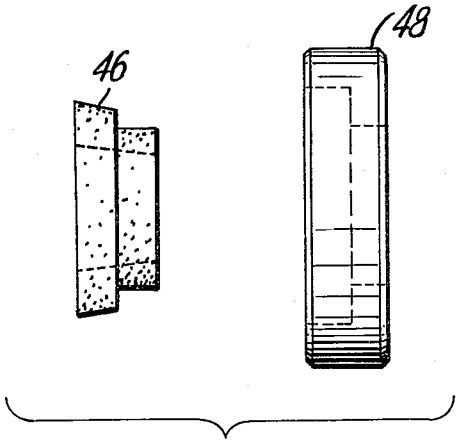
FIG. 2 is an exploded side elevational view of the components of the attractor ring of the subject invention.
Figure 3:
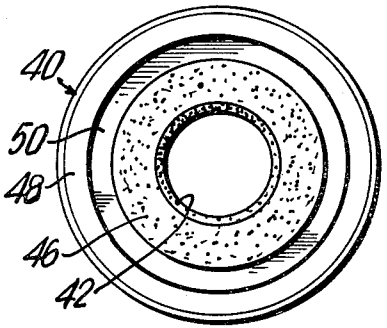
FIG. 3 is an elevational view of the upstream side of the attractor ring.

The structure of the attractor ring 40 is illustrated in FIGS. 2–4. A central opening 42 is provided to allow for the passage of pressurized air and the ionized particles into flow channel 15. FIG. 4 illustrates the attractor ring as viewed from flow channel 15, while FIG. 3 illustrates ring 40 as viewed from the opposed side. The attractor ring 40 is preferably formed of two sections fused together. A solid annular conductive nonporous portion 48 preferably made of brass surrounds a radially inner porous portion 46. The inner porous portion 46 preferably is formed of a sintered mass of metal particles such as copper and brass. By this arrangement, the inner portion 46 remains conductive while allowing a secondary air flow to pass therethrough. A radial channel 50 is provided to uniformly distribute a secondary flow to the porous portion 46. In operation, a secondary air flow will enter channel 50, pass through porous portion 46 emerge into opening 42 of the attractor ring 40 at an angle to the main flow of pressurized air thus dislodging powder particles which may be adhering to the inner porous portion 46.

Figure 5:
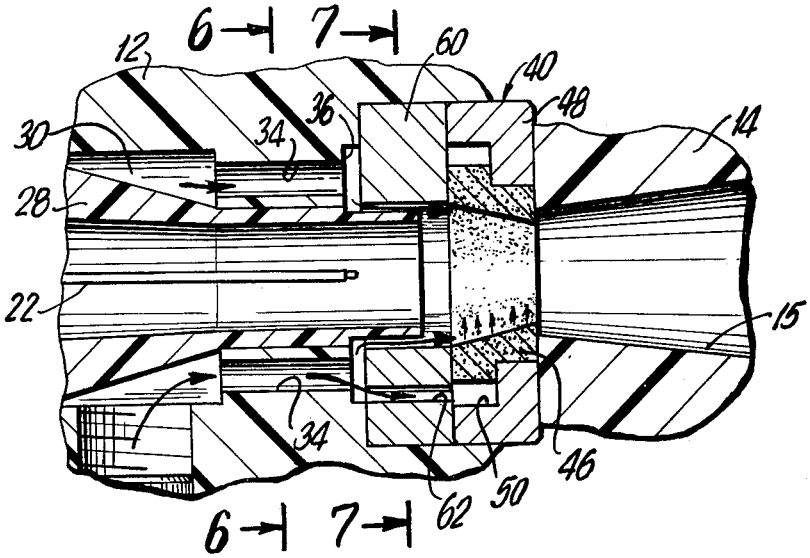
FIG. 5 is an enlarged cross-sectional view of the charging area of the subject electrogasdynamic apparatus.
Figure 6:
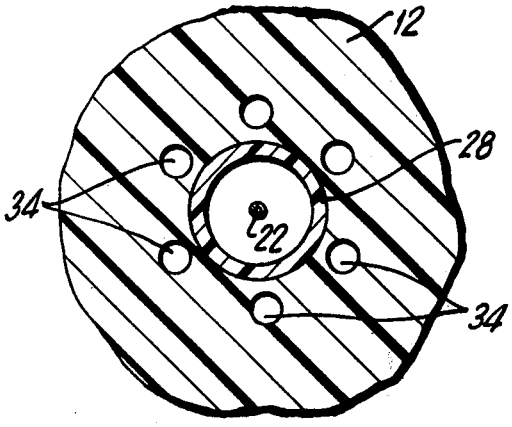
FIG. 6 is a cross-sectional view, taken along line 6—6 of FIG. 5.
Figure 8:
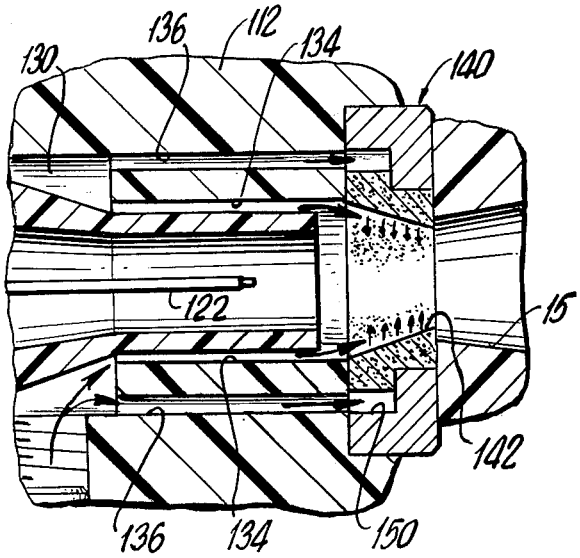
FIG. 8 is an enlarged cross-sectional view, similar to FIG. 5, of a second embodiment of the subject invention.
Figure 7:
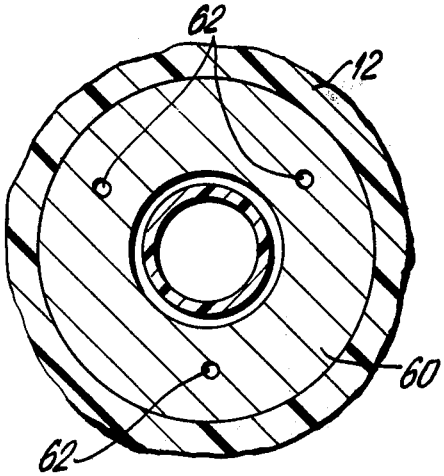
FIG. 7 is a cross-sectional view, taken along line 7—7 of FIG. 5.

A small portion of the main air flow must be directed to the porous portion 46 so that particles may be dislodged. Two examples of different means for diverting a portion of air flow to the porous attractor ring 40 are illustrated in FIGS. 5 and 8. In the embodiment illustrated in FIG. 5, a restrictor ring 60, which may be formed of either a conducting or non-conducting material, is provided with a plurality of holes 62 (see FIG. 7) which communicate with the annular chamber 36 and the radial channel 50 of the attractor ring 40. A minor portion of the air flow passing through annular chamber 36 is diverted through openings 62 in the restrictor ring and is channeled into the radial channel 50 of the attractor ring 40. The secondary flow of pressurized air then passes through the porous portion 46 and literally blows away or dislodges contaminating powder particles off the inner surface of the attractor ring 40. Thus, the build-up of contaminating particles on the attractor ring 40 is substantially reduced. Since the secondary flow emerges from the porous inner portion 46 at random angles to the main flow, it is necessary that only a small portion of the air flow be so diverted to avoid a loss of efficiency. This can be easily controlled by adjusting the number or size of the holes 62 in the restrictor ring 40.

Another advantage derived from the porous inner portion 46 is that since it is formed of a sintered mass of particles, rather than a solid piece, the effective surface area of the inner portion 46 is greater. This increased effective surface area enhances the ability of the attractor ring to create the corona effect, and thus increases the efficiency of operation of the electrogasdynamic apparatus.

The spacing between the attractor ring 40 and the end of the anode needle 34 determines the amount of the charge each particle receives since the longer it takes for a particle to travel from the end of the anode needle 22 through the attractor ring 40, the greater the charge it will pick up in the corona area. The length of time it takes a particle to travel this distance is defined as dwell time. In the embodiment of FIGS. 1–7, the dwell time is determined by the width of the restrictor ring 60.

In the second embodiment of the invention as shown in FIG. 8, the desired dwell time is achieved by virtue of the insulator block 112 which spaces the attractor ring 140 at the appropriate distance from the anode needle 122. The attractor ring 140 corresponds to the attractor ring 40 of the first embodiment. Block 112 includes a first set of openings 134 and a second set of openings 136. Both openings 134 and 136 communicate with annular space 130, while the former communicate with opening 142 in the attractor ring 140, and the latter communicate with radial channel 150. The pressurized air flow is diverted from annular space 130 through either the openings 134 or the openings 136. The main pressurized air flow that is diverted through the openings 134 passes through the central opening 142 of the attractor ring 140 and into the flow channel 15. A minor portion of the pressurized air is directed through openings 136 into the radial channel 150 to dislodge or blow off the coating particles adhering to the portion of the porous portions 146 of attractor ring 140 as in the first embodiment.

In both embodiments, as clearly seen in both FIGS. 5 and 8, it is desirable to taper the cross-section of the attractor ring 40 towards the flow tube 14. The tapering of the attractor ring functions to increase the velocity of the air as it passes through the centered opening 42

(142) of attractor ring 40 (140). Since the particles reaching the far side of the attractor ring are highly charged, the particles have a strong affinity to attach to the end of the attractor ring. Therefore, by increasing the velocity of the air near the end of the attractor ring the attachment of the particles is inhibited.

Additionally, disposed on the end of flow tube 14 is a conically shaped deflector member 70 which is slidably mounted thereto, for varying the spray pattern of the system. The deflector member 70 may be positioned as illustrated in FIG. 1 with the conical end disposed within the central flow channel 15, or it may be displaced at a distance from the end of the flow channel, as illustrated by the dotted lines in FIG. 1.

In operation, pressurized air which enters the subject apparatus through side tube 32 is axially forced through the apparatus towards the workpiece. The pressurized air traveling in one direction creates a suction effect due to aspirator action which will draw powder particles from a reservoir (not shown) through the central channel 16 of the entrance pipe 10. The powder particles pass through conductive washer 20 and through dilution tube 28. The power source connected between the anode needle 22 and the cathode attractor ring 40 creates an electrical discharge or corona effect between them. As the powder particles emerge from the end of the dilution tube 28 they are mixed with the pressurized air, and ionized by the corona discharge. This cloud of pressurized air and ionized particles then passes through the opening 42 in the attractor ring 40, into flow channel 15 towards the workpiece. Additionally, a secondary air flow is provided to the porous portion 46 of the attractor ring 40. This pressurized secondary air flow passes through the porous portion 46 and emerges into the opening 42 in the attractor ring 40 at random angles to the main air flow, to thus dislodge powder particles adhering to the ring 40.

Accordingly, there is provided an electrogasdynamic system with a new and improved attractor ring. The attractor ring has an inner radial portion which is porous. By providing a means for diverting a small portion of the pressurized air flow directly to the attractor ring 40 and through the inner porous portion 46, powder particles, which would normally adhere to the ring 40 causing contamination, are dislodged from the ring 40 permitting greater efficiency and less contamination of the attractor ring 40. In addition, the inner porous portion 46 of the attractor ring 40 is formed of a sintered mass of individual particles, resulting in a greater effective surface area. The greater surface area increases the corona effect produced by the attractor ring 40, and efficiency of the apparatus is increased. Further, a slidably mounted deflector portion 70 is provided for altering the spray pattern of the apparatus. In the operation of the apparatus, the main pressurized air flow carries the powder particles axially through the apparatus while a secondary air flow is passed through the attractor ring 40 at an angle to the main air flow to dislodge contaminating particles.

Although the subject invention has been described by reference to preferred embodiments, it will be apparent that many other modifications could be devised by those skilled in the art that would fall within the spirit and scope of the present invention.

What is claimed is:

1. An electrogasdynamic apparatus for applying a coating to an article comprising:

a longitudinally extending nonconductive conduit for conveying a stream of coating particles from an upstream reservoir and for directing the coating particles downstream towards the article to be coated;

a source of coating particles in communication with said nonconductive conduit;

a source of pressurized air in communication with said nonconductive conduit for carrying said coating particles towards the article to be coated;

a conductive needle axially positioned within said conduit;

an annular conductive attractor member disposed ajdacent said needle for forming a corona discharge area between said attractor member and said conductive needle for ionizing the coating particles passing therethrough, said attractor member having a radially inner porous portion and a radially outer nonporous portion, and wherein said nonporous portion includes an annular channel disposed on the upstream side of said attractor member and in communication with said porous portion; and means for channeling a portion of said pressurized air to said annular channel of said attractor member such that said pressurized air is directed through said porous portion, transverse to the longitudinal axis of said conduit, whereby coating particles which may adhere to said porous portion are dislodged.

2. An apparatus as recited in claim 1 wherein said means for channeling a portion of said pressurized air is a restrictor member disposed adjacent said attractor member and having a plurality of holes communicating with said source of pressurized air and said annular channel of said attractor member, said holes defining passages for the pressurized air flow.

3. An apparatus as recited in claim 1 wherein the opening in said annular attractor member is tapered towards the downstream end of said longitudinally extending conduit to increase the velocity of the air flow therethrough thereby aiding in dislodging coating particles which may adhere thereto.

4. An apparatus as recited in claim 1 wherein said porous portion of said attractor member is formed of metal particles sintered together.

5. An apparatus as recited in claim 1 wherein the downstream end of said longitudinally extending conduit from which the particles are expelled further includes a slidably mounted deflector member for altering the spray pattern of the coating particles.

6. An apparatus as recited in claim 5 wherein the surface of said deflector member adjacent the downstream end of said longitudinally extending conduit is conical in configuration.

* * * * *